US006864456B1

(12) United States Patent
Banghard et al.

(10) Patent No.: US 6,864,456 B1
(45) Date of Patent: Mar. 8, 2005

(54) VACUUM INTERRUPTER CHAMBER WITH RING-SHAPED INSULATOR

(75) Inventors: Johannes-Gerh Banghard, Friedrichsthal (DE); Klemens Fieberg, Berlin (DE); Michael Hahn, Berlin (DE); Werner Hartmann, Grossenseebach (DE); Harald Kurzmann, Berlin (DE); Joerg Kusserow, Neuenhagen (DE); Kathrina Marek, Zepernick (DE); Klaus Oberndoerfer, Berlin (DE); Roman Renz, Berlin (DE); Detlev Schmidt, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/914,193

(22) PCT Filed: Feb. 25, 2000

(86) PCT No.: PCT/DE00/00576

§ 371 (c)(1),
(2), (4) Date: Jan. 3, 2002

(87) PCT Pub. No.: WO00/52719

PCT Pub. Date: Sep. 8, 2000

(30) Foreign Application Priority Data

Feb. 26, 1999 (DE) ..... 199 10 148

(51) Int. Cl.[7] ..... H01H 33/66
(52) U.S. Cl. ..... 218/123; 218/118

(58) Field of Search ..... 218/134, 135, 218/123–125, 127–129, 136–139

(56) References Cited

U.S. PATENT DOCUMENTS

| | | | | |
|---|---|---|---|---|
| 4,216,360 A | * | 8/1980 | Cherry et al. | 218/136 |
| 4,962,289 A | * | 10/1990 | Stegmuller | 218/134 |
| 5,763,848 A | * | 6/1998 | Hakamata et al. | 218/128 |

FOREIGN PATENT DOCUMENTS

| | | |
|---|---|---|
| DE | 1813389 | 9/1970 |
| DE | A1-2725092 | 12/1978 |
| DE | A1-2944286 | 5/1980 |
| DE | A1-3501603 | 8/1985 |
| DE | A1-4422316 | 12/1994 |
| DE | C2-3709585 | 3/1996 |
| DE | C1-19510850 | 7/1996 |
| EP | A1149061 | 7/1985 |
| EP | B1532513 | 3/1993 |

* cited by examiner

*Primary Examiner*—Lincoln Donovan
*Assistant Examiner*—M. Fishman
(74) *Attorney, Agent, or Firm*—Harness, Dickey & Pierce, P.L.C.

(57) ABSTRACT

A new vacuum switching chamber is intended for power breakers in the low-voltage range and is distinguished by a compact form with a small physical height and a high switching capacity. Its enclosure includes a plate-like power current connection, a cylindrical wall part which surrounds flat spiral contacts, an annular insulator and a membrane disk with a centrally arranged power current supply bolt.

13 Claims, 1 Drawing Sheet

VACUUM INTERRUPTER CHAMBER WITH RING-SHAPED INSULATOR

This application is the national phase under 35 U.S.C. § 371 of PCT International Application No. PCT/DE00/00576 which has an International filing date of Feb. 25, 2000, which designated the United States of America, the entire contents of which are hereby incorporated by reference.

FIELD OF THE INVENTION

The invention relates to the field of electrical components, and is applicable, for example, to the design configuration of vacuum switching chambers whose enclosure has two cap-like metal parts and an annular insulator, and which are, for example, intended for switching purposes in the lower A.C. voltage range (up to 1000 V).

BACKGROUND OF THE INVENTION

In a known vacuum switching chamber of this type, the two cap-like metal parts, which are composed of copper, and one of which forms the actual switching area for the stationary contact tip and the axially moving contact tip, are connected in a vacuum-tight manner at the end of the tubular wall region to the annular insulator. In each case, they are connected by blade soldering. In order to allow this known vacuum switching chamber to reliably switch short-circuit currents in the range from 50 to 100 kA while having axial and radial dimensions which are as small as possible, a folding bellows is soldered by one of its ends to the contact bolts of the moving contact tip, and in the immediate vicinity of the latter, and is surrounded concentrically by the annular insulator; a cap-like protective shield at the bottom of the moving contact tip in this case protects the folding bellows against electrical loads. This vacuum interrupter has no special shield for protection of the inner isolating gap which is formed by the annular insulator, since a relatively broad end surface of the annular insulator faces away from the contact region. The power current connections of this known vacuum switching chamber are—as normal—in the form of bolts, which pass axially through the respective cap-like metal part. The two contact tips are normally in the form of pot-type contacts; however, other known contact shapes may also be used (DE 44 22 316 A1). Another known contact shape is, for example, spiral contacts (spiral petal contacts) with, in particular, flat, plate-like contact electrodes, which are provided with slits running inward from the outer circumference. These slits may each comprise a straight section and a hole which passes through the contact surface (EP 0 532 513 B1).

Vacuum interrupters are already known as switching elements for low-voltage contactors, in which the folding bellows forms a part of the outer surface of the enclosure and in this case connected in a vacuum-tight manner on one side to the power current connection of the moving contact bolt and on the other side, at the end, to a short tubular insulator (DE 37 09 585 C2). A folding bellows may in this case be connected by blade soldering both to the insulator and to the power current connection of the moving contact bolt (DE 195 10 850 C1).

Furthermore, vacuum switches are known for shunt operation of D.C. electrolysis cells, which have to switch a current of about 4000 A with a switching voltage of about 4 volts, and in which cylindrical contacts are incorporated in planar, conductive end plates, in order to allow the switch to be electrically connected to electrical connecting rails. In this case, each contact is soldered in a vacuum-tight manner via a corrugated membrane in the form of a disk to an insulating ring, which is arranged concentrically about the switching path. In one case, a holder for a shield in the form of a short piece of tubing is incorporated in the soldered joint, (which is produced as a blade soldered joint by means of an axial annular flange) between the membranes and the insulating ring (U.S. Pat. No. 4,216,360 A, DE 29 44 286 A).

For vacuum switches which are used as vacuum contactors for low voltage, it is also known for a membrane which is provided with two deep, concentrically arranged, corrugations also to be used instead of a folding bellows as a sprung closure part for the switching chamber, which allows the moving contact tip to move. The two parts of the transversely split power current connecting bolt of the moving contact are soldered to this region of the membrane in the central region of the membrane, which is planar (DE 27 25 092 A1).

SUMMARY OF THE INVENTION

The present invention is based on an object, for example, of further reducing the physical size of the known vacuum switching chamber, while at the same time increasing the switching capacity in the process.

In order to achieve this object, the invention proposes that the power current connection of the stationary contact tip is in the form of a plate, that the metal part which surrounds the two contact tips is tubular and is connected at the end to the plate, and that the resilient, metallic separating wall comprises a membrane which is provided with concentric corrugations, is in the form of a disk, and is soldered on one side to the power current connection (which is in the form of a bolt) of the moving contact tip and on the other side via an axially running annular flange to the annular insulator.

Such a configuration of the vacuum switching chambers leads to a flat shape with a physical height which is considerably less than that of conventional vacuum interrupters. A contributory factor here is firstly the configuration of the one power current connection as a plate instead of a cylindrical bolt, as was normal in the past, with this plate at the same time forming an end cover for the intrinsically cylindrical switching chamber. Another contributory factor is the use of a corrugated membrane instead of the otherwise normal folding bellows.

In order to ensure the necessary number of switching operations (at least 10,000 for example) for a switching movement of about 3 to 5 mm with this abnormal use of a membrane for a vacuum switching chamber which is used in a low-voltage A.C. power supply system, the number and depth of the corrugations for the membrane have to be designed appropriately. For this purpose, a further refinement of the invention provides that, with a wall thickness of between 0.1 and 0.2 mm and a corrugation depth of approximately half the switching movement, the membrane has a number Z of full corrugations which is greater than 1+integer of the cube root of the external membrane diameter $D_A$ minus the power current connecting bolt diameter $D_B$ multiplied by the wall thickness s of the membrane, but at least 3, with the individual dimensions to be used being in millimeters. The boundary condition mentioned above is expressed as a mathematically formulated relationship as follows:

$$Z \tau 1+\text{integer}\ (\sqrt[3]{[(D_A-D_B)*s]}),\ \text{at least 3.}$$

Such a configuration of the membrane allows the corrugation to be chosen such that the radius of curvature corresponds approximately to the switching movement, and the individual corrugation trough corresponds to a circular arc with a circumferential angle of about 90°. However, the corrugation may also be in the form of a sine wave with straight flanks.

The novel switching chamber can be refined further by design measures such as those already proposed in the prior German Patent Application 198 02 893.8. According to this document, the flat shape of the novel vacuum switching chamber can be pronounced to an even greater extent if the contact tips are in the form of spiral contacts, in particular flat spiral contacts. The use of spiral contacts also leads to better arc management, thus resulting in an improved switching capacity. For example, the use of flat spiral contacts with a diameter of about 90 mm allows short-circuit currents of up to about 130 kA to be switched. Irrespective of the diameter of the spiral contacts, it is recommended that a vapor barrier in the form of a disk be positioned between the moving contact tip and the associated power current connecting bolt, which vapor barrier is composed, for example, of a chromium-nickel steel and which, for vacuum switching chambers with a small switching capacity, can possibly be used for mechanical reinforcement of the moving spiral contact, whose thickness is reduced.

The novel refinement of the vacuum switching chamber also allows direct connection of the stationary contact tip to the associated plate-like power current connection, thus ensuring optimum heat dissipation when using a connecting bolt with a large diameter for the moving contact tip. The overall compact shape means that there is no need for any special guidance for the connecting bolt for the moving contact tip, as has been normal in the past for vacuum interrupters for power breakers when using a plastic bush. This allows the vacuum switching chamber to be more highly thermally loaded.

The novel design of the vacuum switching chamber also allows all the individual parts—except for the annular insulator—to be constructed such that they are self-centering, so that all the individual parts can be soldered to one another in a single operation (closure soldering) without using any expensive and complex soldering forms. To this end, it is recommended that the stationary contact tip be connected via a short centering stub to the plate-like power current connection, while the moving contact tip is connected to the corrugated membrane, centered via the contact bolt.

The shape of the tubular part which surrounds the two contact tips—particularly when they are in the form of flat spiral contacts—depends on the respectively intended switching capacity. For low switching capacities from about 40 to 60 kA, this part may be in the form of a hollow cylinder. For higher switching capacities, that is to say for larger contact diameters, it is recommended that the tubular part be provided with a conical taper at the end facing the annular insulator, this allows the use of an insulator and a corrugated membrane having a considerably smaller diameter than that of the spiral contacts. Irrespective of the shape of the tubular part, which is preferably composed of copper, it is recommended that this tubular part be provided with arc-resistant cladding on the inner wall in the region of the switching path, for example by using sheet-metal parts composed of a chromium-copper composite material, or by electrochemical plating with chromium.

The insulating ring which is arranged between the corrugated membrane and the tubular part of the enclosure can, in a known manner, be formed by appropriate configuration of its cross-sectional contour such that there is no need to arrange a shield for protection against the deposition of metal vapor particles. If, on the other hand, the insulating ring is carrying out only an insulating function, the tubular metal part may have an attachment which acts as a vapor shield, as has already been proposed per se in the prior German Patent Application 198 26 766.5. With the metal part having these two functions, the transition from the area associated with the enclosure to the area which is used as the vapor shield has a corrugated form, so that the metal part touches the end surface of the insulating ring only in the form of a line, and thus allows a type of blade soldering in this area.

BRIEF DESCRIPTION OF THE DRAWINGS

Two exemplary embodiments of the novel switching chamber are illustrated in FIGS. 1 and 2, in which.

DETAILED DESCRIPTION OF THE PREFERRED EMBODIMENTS

Figure 1:
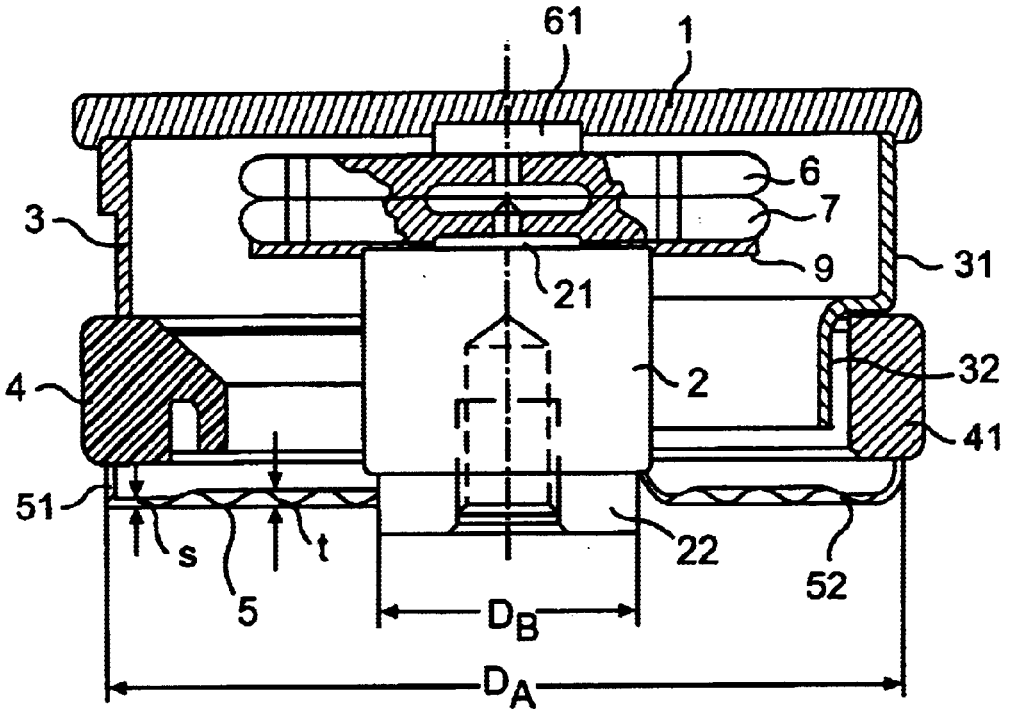
FIG. 1 shows a cross section of the switching chamber.

In the illustrated vacuum switching chamber, the enclosure comprises an upper metallic plate 1 which acts as the power current connection and is composed of copper, a hollow-cylindrical wall part 3 which is butt-soldered to it and is composed of copper, an annular insulator 4, a corrugated membrane 5 which is arranged coaxially with respect to the annular insulator 4, and a cylindrical power current connecting bolt 2. In this case, the annular insulator is designed in the same way as the insulator according to DE 44 22 316 A1, that is to say with an approximately square cross section and with a chamber and an undercut. A stationary flat spiral contact 6 and a moving flat spiral contact 7 are arranged within the enclosure. The spiral contact 6 is connected to the plate 1 via a short centering stub 61, which engages in a centering hole in the spiral contact. The spiral contact 7 is seated on a centering attachment 21 on the power current supply bolt 2, which attachment acts as a constriction to the current flow. This is soldered at its other end to the corrugated membrane 5, in the region of a centering attachment 22. The membrane 5 is itself soldered to the insulator 4 via the axially running annular flange 51. This annular flange can be formed integrally with the membrane. A vapor barrier 9 in the form of a flat disk composed of a mechanically strong material such as chromium-nickel steel is also arranged between the moving spiral contact 7 and the power current supply bolt 2. This vapor barrier 9 is used to shadow the annular insulator 4 from metal particles released from the spiral contacts 6 and 7 during the switching process.

The construction of the vacuum switching chamber is chosen such that all the individual parts can be soldered to one another in the course of a single soldering process. The degassing gaps required for this purpose can be provided with means, which are known from the prior art, in the joint region between the annular insulator 4 and the hollow-cylindrical wall part 3.

In the illustration shown in FIG. 1, two different embodiments are illustrated of the tubular metal part which is arranged between the plate-like power current connection 1 and the annular insulator 4. In the left-hand part of the illustration, a tubular part 3 is provided as the wall part, whose ends are soldered firstly to the metallic plate 1 and secondly to one end surface in the annular insulator 4; in the right-hand part of the illustration, the wall part 31 is formed integrally with a shield 32, and is slightly corrugated in the transitional region from the wall part to the shield. In addition, an insulating ring 41 which has a simple, rectangular cross section is used in the right-hand part of the illustration. Furthermore, FIG. 1 shows two different embodiments for the connection of the corrugated membrane 5 to the power current connecting bolt 2. In the left-hand illustration, blade soldering on the circumference of the power current connecting bolt 2 is provided, while, in or in the illustration on the righthand side, the corrugated membrane 52 is soldered to the power current connecting bolt 2 in the region of a centering shoulder. Furthermore, an annular flange 51 which is welded to the membrane is provided in the left-hand illustration, while the annular flange is formed integrally with the membrane in the right-hand illustration.

Figure 2:
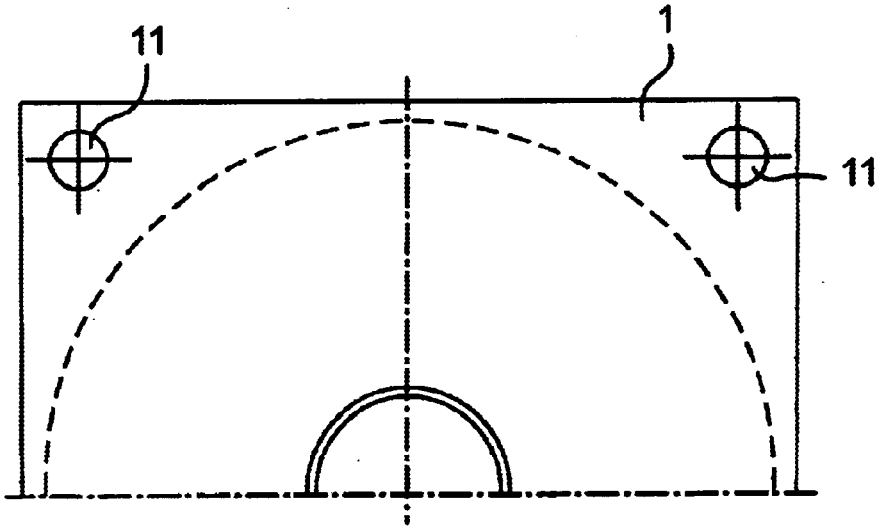
FIG. 2 shows a plan view of the plate-like power current connection.

FIG. 2 shows a plan View of the plate 1, which acts as the power current connection, for the vacuum switching chamber shown in FIG. 1. Rectangular or square shaping of the planar plate 1 leaves sufficient space for holes 11, which are used to attach the power current connection to a corresponding part of an associated switching device.

The membrane shown in FIG. 1 may, for example, have the following dimensions:

External diameter: $D_A$: 77 mm

Internal diameter (diameter of the power current connecting bolt):

$D_B$: 25 mm

Wall thickness: s: 0.2 mm

Corrugation depth (distance between the corrugation peak and the corrugation trough): t: 2 mm Number Z of corrugations: $\geqq 3$.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vacuum switching chamber for switching short-circuit currents in the low-voltage range, including a stationary contact tip and a contact tip which can move axially with respect to the stationary contact tip, each contact tip including an associated power current connection, comprising:

an enclosure which surrounds the contacts, with the power current connection of the moving contact tip being in the form of a cylindrical bolt, the enclosure including rigid metal parts, an annular insulator and a resilient gas-tight metallic separating wall, connected to one another in an arrangement and connected in a gas-tight manner to the power current connections of the contact tips, and surrounding one of the rigid metal parts together with both the stationary contact tip and the moving contact tip, wherein the power current connection of the stationary contact tip is in the form of a plate, the metal part which surrounds the two contact tips is tubular and is connected at the end to the plate, and wherein the resilient, metallic separating wall includes a membrane which is provided with concentric corrugations, is in the form of a disk, and is soldered on one side to the power current connection of the moving contact tip and on the other side via an axially running annular flange to the annular insulator, wherein the plate forms a relatively flat top portion of the enclosure and wherein the plate is connected to the stationary contact tip via a centering stub which is relatively shorter than the cylindrical bolt.

2. The vacuum switching chamber as claimed in claim 1, wherein, for a switching movement of 3 to 5 mm, the membrane includes:

a wall thickness s of between 0.1 and 0.2 mm, a corrugation depth t of approximately half the switching movement, and a number Z of full corrugations, all of which satisfy the condition $Z \geqq 1+\text{integer}\ (\sqrt[3]{[(D_A-D_B) * s]})$, at least 3, where $D_A$=external diameter of the membrane, $D_B$=diameter of the power current connecting bolt of the moving contact tip, and s=thickness of the membrane.

3. The vacuum switching chamber as claimed in claim 1, wherein the contact tips are in the form of flat spiral contacts.

4. The vacuum switching chamber as claimed in claim 2, wherein the contact tips are in the form of flat spiral contacts.

5. The vacuum switching chamber as claimed in claim 1, wherein the plate is proximate to the stationary contact tip.

6. A vacuum switching chamber for switching short-circuit currents in the low-voltage range, including a stationary contact tip and a contact tip which can move axially with respect to the stationary contact tip, each contact tip including an associated power current connection, comprising:

an enclosure which surrounds the contacts, with the power current connection of the moving contact tip being in the form of a cylindrical bolt, the enclosure including rigid metal parts, an annular insulator and a resilient gas-tight metallic separating wall, connected to one another in an arrangement and connected in a gas-tight manner to the power current connections of the contact tips, and surrounding one of the rigid metal parts together with both the stationary contact tip and the moving contact tip, wherein the power current connection of the stationary contact tip is in the form of a plate, the metal part which surrounds the two contact tips is tubular and is connected at the end to the plate, wherein the resilient, metallic separating wall includes a membrane which is provided with concentric corrugations, is in the form of a disk, and is soldered on one side to the power current connection of the moving contact tip and on the other side via an axially running annular flange to the annular insulator, wherein the plate forms a relatively flat top portion of the enclosure and wherein the plate is directly connected to the stationary contact.

7. A vacuum switching chamber, comprising:

a stationary contact;

a movable contact, movable with respect to the stationary contact;

a bolt, in contact with the movable contact and acting as a power current connection for the movable contact;

an enclosure surrounding the contacts and the bolt; and a plate-like power current connection for the stationary contact, the plate-like power current connection forming a relatively flat top portion of the enclosure wherein the plate-like power current connection for the stationary contact is connected to the stationary contact via a centering stub which is relatively shorter than the bolt.

8. The vacuum switching chamber of claim 7, further comprising an annular insulator and a resilient gas-tight metallic separating wall, connected to one another in an arrangement and connected in a gas-tight manner to the power current connections of the contacts, wherein the resilient gas-tight metallic separating wall includes a membrane provided with concentric corrugations in the form of a disk.

9. The vacuum switching chamber of claim 8, wherein, for a switching movement of 3 to 5 mm, the membrane includes:

a wall thickness s of between 0.1 and 0.2 mm, a corrugation depth t of approximately half the switching movement, and a number Z of full corrugations, all of which satisfy the condition $Z \geqq 1+\text{integer}\,(\sqrt[3]{[(D_A-D_B) * s]})$, at least 3, where $D_A$=external diameter of the membrane, $D_B$=diameter of the power current connecting bolt of the movable contact, and s=thickness of the membrane.

10. The vacuum switching chamber as claimed in claims 7, wherein the contacts are in the form of flat spiral contacts.

11. The vacuum switching chamber as claimed in claim 9, wherein the contacts are in the form of flat spiral contacts.

12. The vacuum switching chamber as claimed in claim 7, wherein the plate-like power current connection for the stationary contact is proximate to the stationary contact.

13. A vacuum switching chamber, comprising:

a stationary contact, a movable contact, movable with respect to the stationary contact;

a bolt, in contact with the movable contact and acting as a power current connection for the moveable contact;

an enclosure surrounding the contacts and the bolt; and a plate-like power current connection for the stationary contact, the plate-like power current connection forming a relatively flat top portion of the enclosure, wherein the plate-like power current connection for the stationary contact is directly connected to the stationary contact.

* * * * *